US007140281B1

(12) United States Patent
Ruff

(10) Patent No.: US 7,140,281 B1
(45) Date of Patent: Nov. 28, 2006

(54) ELASTIC CONNECTION WEDGE WRENCH

(76) Inventor: Jim Ruff, 2205 Hwy 7 N., Harrison, AR (US) 72601

( * ) Notice: Subject to any disclaimer, the term of this patent is extended or adjusted under 35 U.S.C. 154(b) by 0 days.

(21) Appl. No.: 11/041,380

(22) Filed: Jan. 24, 2005

(51) Int. Cl.
*B25B 23/10* (2006.01)

(52) U.S. Cl. ..... 81/452; 81/448

(58) Field of Classification Search ..... 81/452, 81/451, 442, 443, 448, 450, 453–455, 446
See application file for complete search history.

(56) References Cited

U.S. PATENT DOCUMENTS

| | | | | | |
|---|---|---|---|---|---|
| 573,325 | A | * | 12/1896 | Gates | 81/446 |
| 785,162 | A | | 3/1905 | Freytag | |
| 1,275,810 | A | * | 8/1918 | White | 81/443 |
| 1,522,968 | A | * | 1/1925 | Milligan | 81/444 |
| 2,455,005 | A | | 11/1948 | Hall | |
| 2,657,605 | A | * | 11/1953 | Howell | 81/446 |
| 3,224,479 | A | | 12/1965 | Osborn et al. | |
| 3,286,749 | A | | 11/1966 | Learned | |
| 3,733,937 | A | | 5/1973 | Mezey | |
| 4,625,598 | A | * | 12/1986 | Wolfram | 81/436 |
| 4,890,521 | A | | 1/1990 | Bien | |
| 5,927,165 | A | | 7/1999 | Vasudeva | |

* cited by examiner

*Primary Examiner*—Hadi Shakeri
(74) *Attorney, Agent, or Firm*—Keisling Pieper & Scott PLC; David B. Pieper; Trent C. Keisling

(57) ABSTRACT

A tool, specifically described for a hex wrench, using a split head with the pieces joined by an elastic connector allowing for deformation of the exterior of the head shape to wedge into the hex socket. The split pieces of the head have an exterior profile matching the shape of the socket and the interior split has a cam profile that enhances the wedging action of the tool. The elastic allows for the tool to return to the original shape.

14 Claims, 5 Drawing Sheets

ELASTIC CONNECTION WEDGE WRENCH

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of wrenches. In particular, the present invention relates specifically to a hex wrench using an elastic connection for control of an internal expansion profile for providing a wedge type of engagement. Known art may be found in U.S. Class 81, subclass 436, 439 448; Class 411, Subclass 403 as well as in other classes and subclasses.

2. Description of the Known Art

As will be appreciated by those skilled in the art, hex wrenches are well known. Patents disclosing information relevant to improved engagement tools include U.S. Pat. No. 785,162, issued to Freytag on Mar. 21, 1905; U.S. Pat. No. 2,455,005, issued to Hall on Nov. 30, 1948; U.S. Pat. No. 3,224,479, issued to Osborn et al. on Dec. 21, 1965; U.S. Pat. No. 3,286,749, issued to Learned on Nov. 22, 1966; U.S. Pat. No. 3,733,937, issued to Mezey on May 22, 1973; U.S. Pat. No. 4,890,521, issued to Bien on Jan. 2, 1990; and U.S. Pat. No. 5,927,165, issued to Vasudeva on Jul. 27, 1999. Each of these patents is hereby expressly incorporated by reference in their entirety.

U.S. Pat. No. 3,733,937 issued to Mezey on May 22, 1973 discloses a wrench having a plurality of sides is formed with a head at one end for insertion into a socket of a screw or bolt having a corresponding number of sides. A horizontally springy neck of the wrench is integral with a head and with a tip spaced axially from the head. The tip is offset circumferentially from the head approximately 5° to 10°. A similar head, springy neck and offset tip may be provided at the other end of the wrench. The wrench may be straight or L-shaped and have any number of sides greater than two.

U.S. Pat. No. 4,890,521 issued to Bien on Jan. 2, 1990 discloses a power driven screw driver self-gripping composite bit in the form of a pair of mirror image halved elements united at a common oblique interface providing a square end driver for reception in a screw head formed with a combined socket that accepts both a square end bit and a cross-point bit. Each halved element driver portion defines a trapezoidal cross section having major and minor parallel exterior side surfaces, a complete side surface extending at right angles to its major and minor surfaces, and a diagonal-like interface. The composite bit holder resiliently biases the halved elements interfaces into coextensive flush contact normally defining a square end driver. Upon threading torque being applied to the composite bit by a power screw driver the halved elements slip along their interfaces expanding the bit complete side surfaces in opposite directions so as to wedgingly engage their associated socket side faces into positive holding contact obviating slippage of the composite bit square end driver from the combined socket.

U.S. Pat. No. 5,927,165 issued to Vasudeva on Jul. 27, 1999 discloses a fastener-driving tool that has a locking insert which expands or displaces to more securely lock the tool in the fastener. The tool has a distal end configured to engage a driving recess in a fastener, and has an annular recess adjacent the distal end, with a reduced cross-section at the annular recess, other than an axial circular cross-section. A locking insert having a generally similar cross-section to that of the distal end is positioned in the annular recess closely around the reduced cross-section. The locking insert may have a split portion which permits expansion of the locking insert when acted upon by the reduced cross-section as a result of rotation of the distal end relative to the locking insert, or may provide locking simply by displacement resulting from being acted upon by the reduced cross-section.

Thus, it may be seen that these prior art patents are very limited in their teaching and utilization, and an improved elastic connection hex wrench is needed to overcome these limitations.

SUMMARY OF THE INVENTION

The present invention is directed to an improved elastic connection hex wrench. In accordance with one exemplary embodiment of the present invention, a hex key device is provided using two sections using a cam action connected by an elastic plug to allow for deformity with return bias to the original position. The cam action provides for an increased pressure and the two section design utilizing different sides of the tool allows for consistent deployment of the wedging action that is absent in prior art designs.

The present invention utilizes a first section having an exposed surface defining a portion of an exterior tool shape and an interior portion defining a first expansion profile. This first section is mated with a second section defining an additional portion of the exterior tool shape and an interior portion defining a second expansion profile, the first expansion profile and the second expansion profile adapted to relatively rotate to expand the exterior tool shape and are connected by an elastomeric connector attaching the first section to the second section. The elastomeric connector is a plug inserted into plug apertures in the sections with a cylindrical shape that provides a curved profile adapted to minimize shearing of the plug and a cross section greater than the movement of the two pieces to allow for movement of the sections without shearing of the plug. A handle or bent extension may be added to adapt the invention to the human hand.

A method for manufacturing the invention is also taught with the cooling of the cooling the elastomeric plug in order to harden it for insertion into the sections of the tool.

The object of the invention is to provide a wedging type of hex wrench or tool which actually works consistently to provide increased fastener gripping to minimize the stripping of connectors or fasteners currently found with known tools.

By utilizing two heads that pivot off one another, the dual action hex key creates additional leverage while simultaneously pushing the edges of the hex key further into the corners of the hex bolt to keep the tool from stripping the bolt and/or rounding off the edges of the hex key. The specific cut of the dual heads was selected to facilitate the rotation of the heads to allow the heads to pivot off of one another. The primary purpose of the rubber dowel is to connect and hold the two pieces together.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 13 is an end view of the cap on the body in an increased offset position in a corresponding opening.

DETAILED DESCRIPTION OF THE INVENTION

Figure 1:
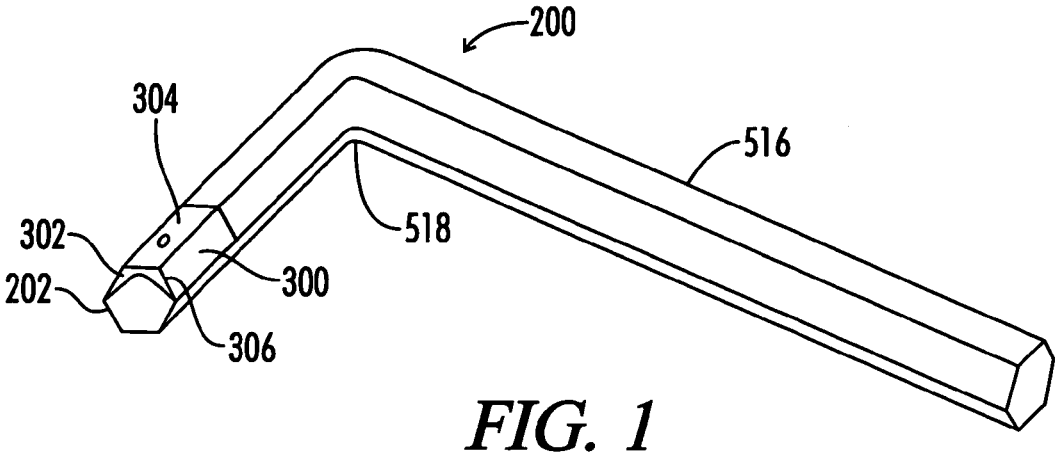
FIG. 1 is a schematic view of a hex wrench embodying the present invention.

As shown in FIGS. 1 through 13 of the drawings, one exemplary embodiment of the present invention is generally shown as a male tool device 200 using a cap section 300 and a base section 400 connected by an elastomeric plug 500. To understand operation of this invention, an understanding is need of the structure of the female aperture 100 and the device 200.

FIGS. 3 through 4 and 11 through 13 show the operation of the male tool device with a female aperture 100. It is well understood how a normal hex wrench is inserted into the female aperture and used to turn the corresponding fastener or structure. The present invention is used similarly, although the actual contact between the male tool device 200 and the aperture side surface 110 is changed. The female aperture 100 is shown with an aperture shape 102 of a hexagon 104 as a standard shape used in industry. The drawings show that the aperture 100 has an aperture width 106 and aperture depth 108 defining an aperture side surface 110. The aperture side surface 110 for the hexagon shape includes a first aperture wall 112, a second first aperture wall 114, a third aperture wall 116, a fourth aperture wall 118, a fifth aperture wall 120, and a sixth aperture wall 122. with this definition of the aperture, a corresponding understanding is needed of the structure of the male tool device 200.

The male tool device 200 is shown in the preferred embodiment of a six sided hexagon 202 with the device 200 using a cap section 300 connected to a base section 400 by an elastomeric plug 500. The preferred material is a tool steel following ASTM A681 Type S-2 (UNS#41902) which is available in the hexagonal shape. This steel may be water hardened to an appropriate hardness such as a 59-60 Hardness Rockwell C.

The cap section 300 includes a cap front face 302 and an exposed surface 304 defining an exterior tool shape 306. In the preferred embodiment, the cap portion of the exterior tool shape for the hexagon includes a first side 308, a second side 310, and a third side 312. The cap has a cap rear face 314 on the inward side of the device 200 with a cap interior portion 316 defining a cap expansion profile 318 along the cap length 320 that is used to create the cam effect for the invention. The cap also defines a cap plug aperture 322 having a cap aperture diameter 324 and a cap aperture depth 326. For the preferred embodiment, the cap aperture depth 326 passes all the way through the cap 300.

The cap 300 is mounted onto a base section 400 having a base front face 402 and a base exposed surface 404 defining an exterior base shape 406. For the hexagon shape, the exterior base shape 406 includes a fourth side 408, a fifth side 410, and a sixth side 412. The inner portion of the base section 400 includes a base cliff face 414 and a base interior portion 416 defining a base expansion profile 418 along the base interior length 420 for use with the cap expansion profile 318. The base also includes a base plug aperture 422 having a base aperture diameter 424 with a base aperture depth 426.

The elastomeric plug 500 is inserted into the cap plug aperture 322 and the base plug aperture 422 to connect the cap 300 to the base 400. The primary purpose of the plug 500 is to connect the two sections together. The plug 500 must be flexible enough to allow the heads to rotate in relation to each other while being strong enough to withstand the stress during use. Recommended materials are rubber, TEFLON a trademarked product by DUPONT of Wilmington, Del., nylon, flexible acrylics, and silicon although other materials should also be considered based on design characteristics and cost. The plug 500 has a cylindrical body 502 defining a curved profile 504 which spreads shearing forces over a broad area to help minimize the possibility of shearing of the elastomer. The plug 500 defines a circular cross section 506 having a plug diameter 508 that is chosen to be greater than the expected movement of the cap 300 in relation to the base 400. This size choice allows for the movement of the cap 300 in relation to the base 400 for a distance 512 without the shearing of the elastomeric plug 500 during normal use. The plug is designed with a plug length 510 associated with the cap plug aperture 322 and the base plug aperture 422 in order to provide sufficient friction to retain the plug in both apertures 322, 422 during normal use.

Figure 2:
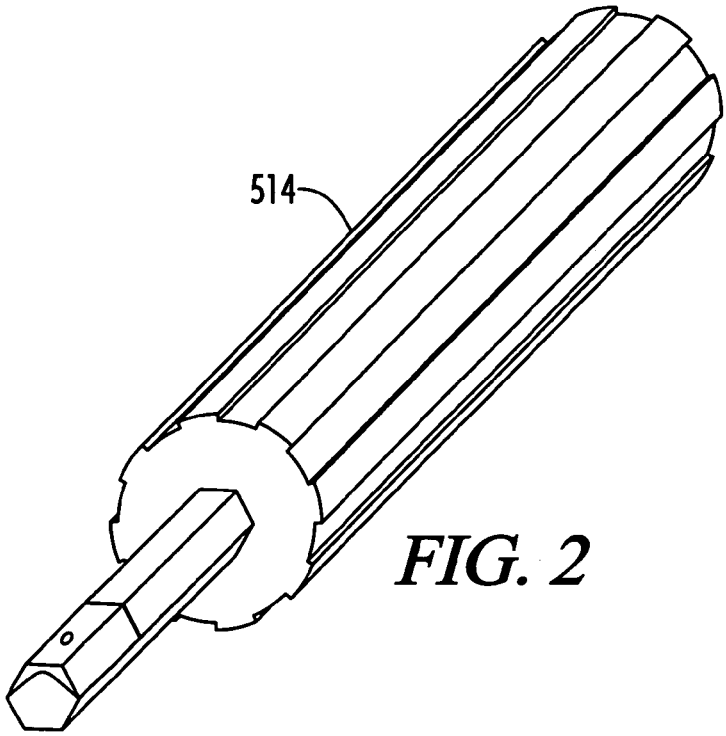
FIG. 2 is a schematic view of a hex tool embodying the present invention.
Figure 3:
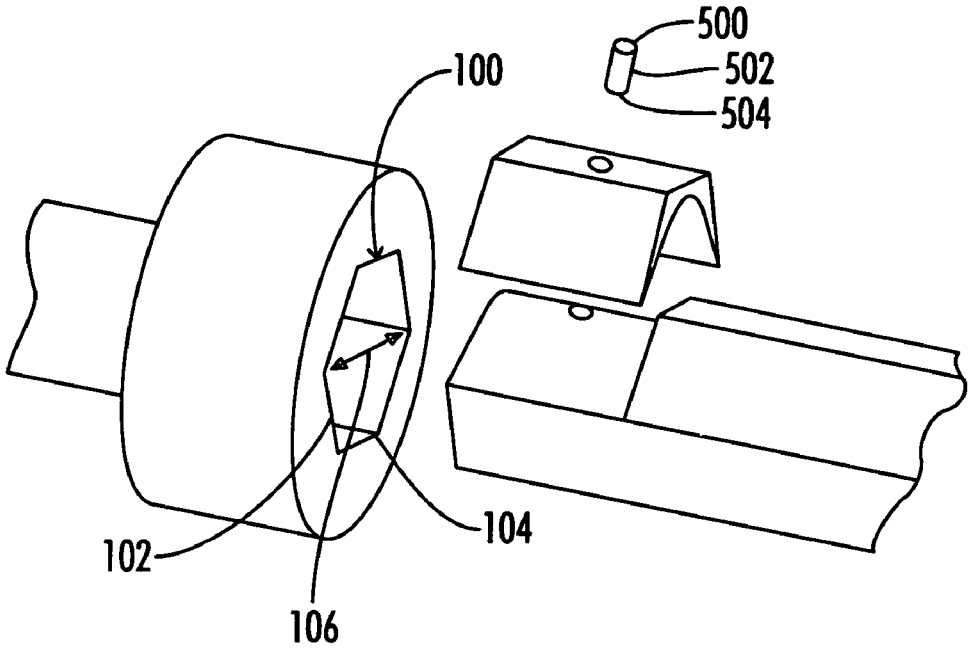
FIG. 3 is an exploded perspective view of a hex head embodying the present invention before insertion into a fastener.
Figure 4:
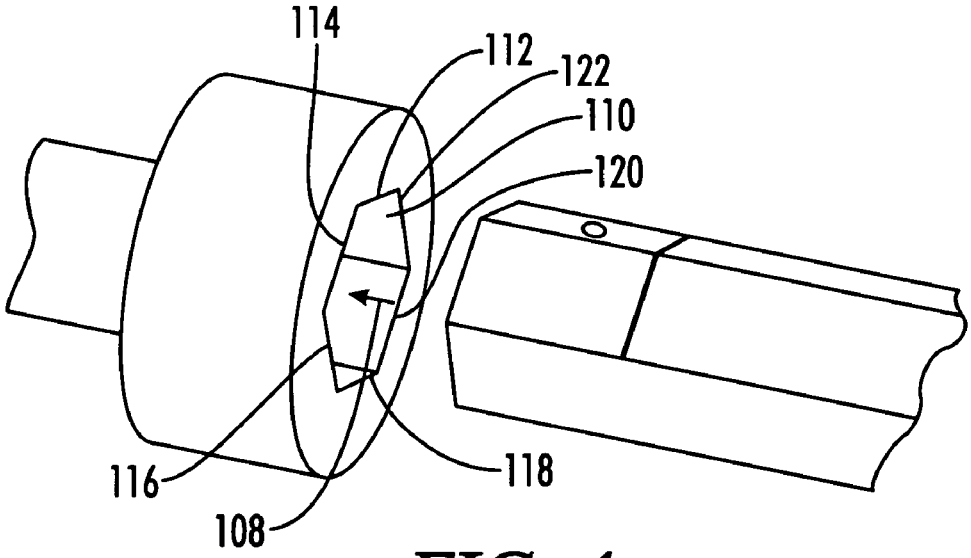
FIG. 4 is an assembled perspective view of a hex head embodying the present invention before insertion into a fastener.
Figure 5:
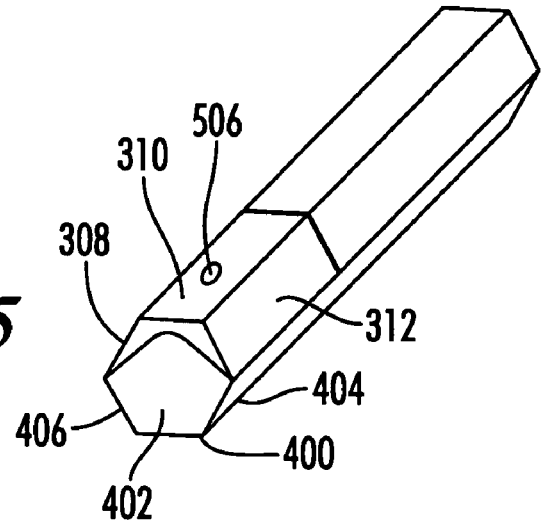
FIG. 5 is a perspective view of the cap on the body in a ready position.
Figure 6:
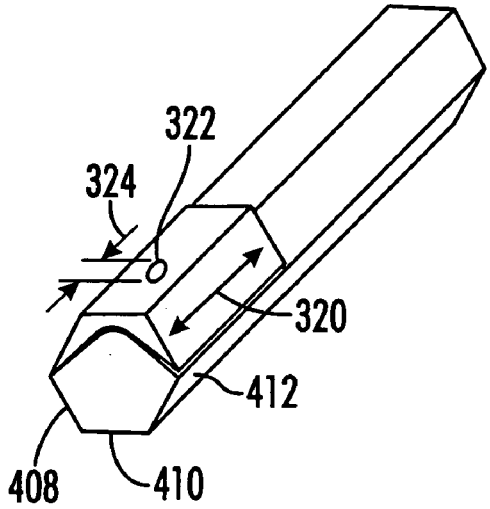
FIG. 6 is a perspective view of the cap on the body in an initial offset position.
Figure 7:
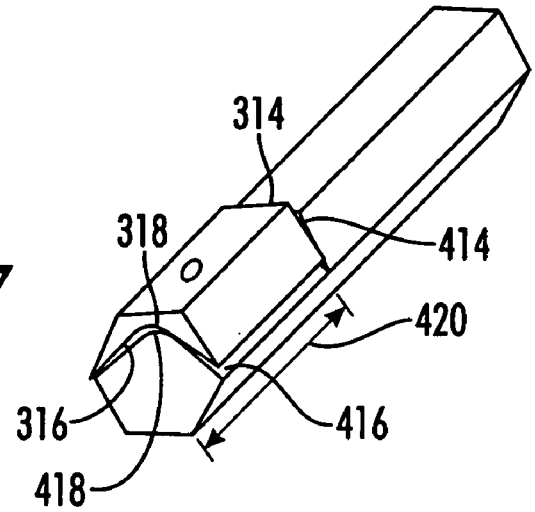
FIG. 7 is a perspective view of the cap on the body in an increased offset position.
Figure 10:
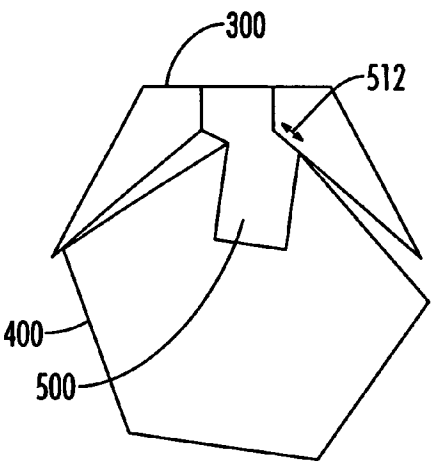
FIG. 10 is an end view of the cap on the body in an increased offset position.
Figure 9:
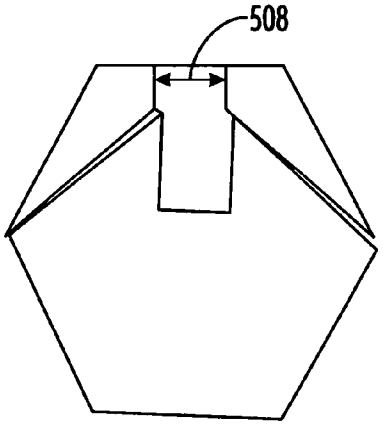
FIG. 9 is an end view of the cap on the body in an initial offset position.
Figure 8:
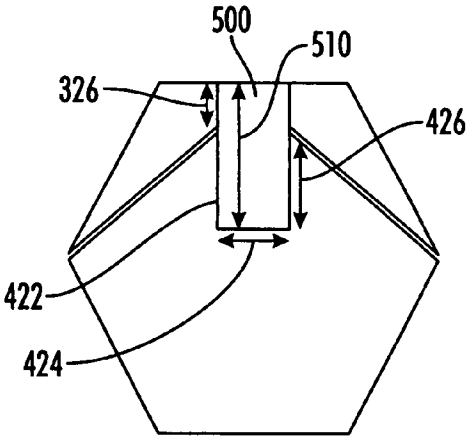
FIG. 8 is an end view of the cap on the body in a ready position.
Figure 113:
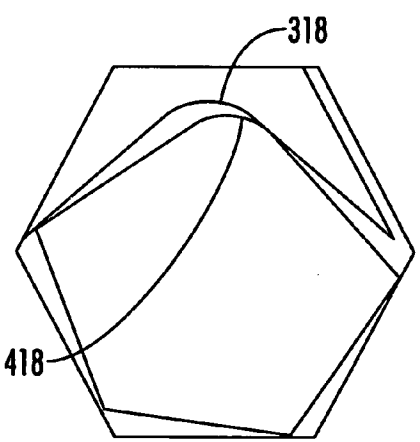
Figure 12:
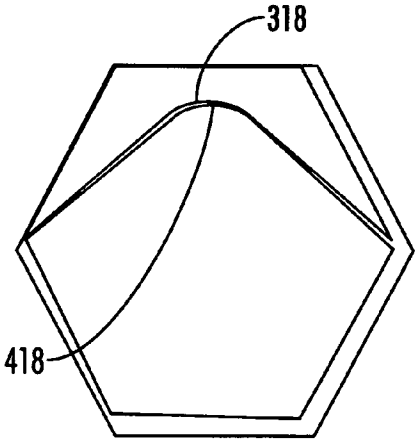
FIG. 12 is an end view of the cap on the body in an initial offset position in a corresponding opening.
Figure 11:
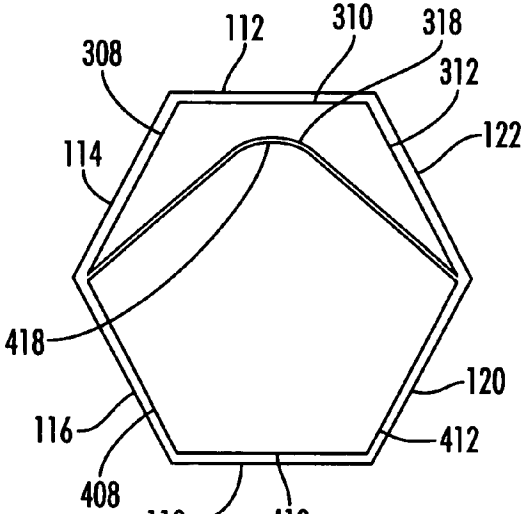
FIG. 11 is an end view of the cap on the body in a ready position in a corresponding opening.

FIGS. 1 and 2 shown how a handle 514 may be added to the device using convention construction techniques or a gripping arm may be made using a bent extension 516 to form an L-shape 518.

Figure 14:
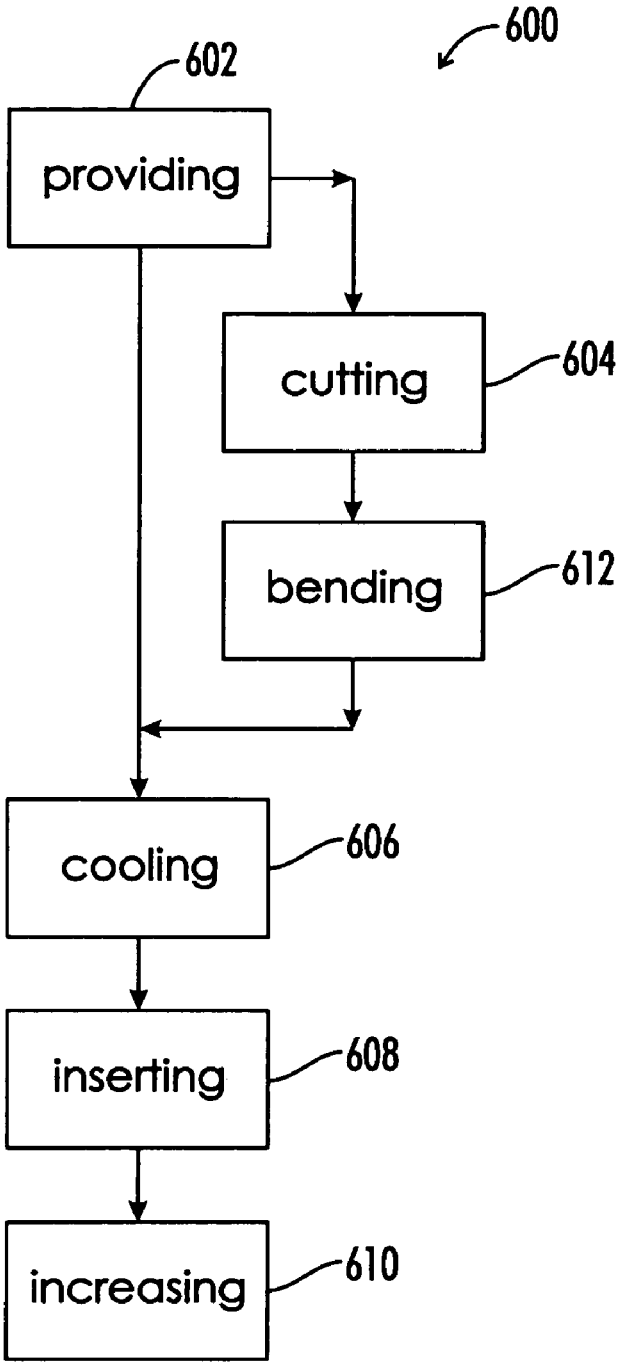
FIG. 14 is a schematic view of a method for manufacturing the device.

FIG. 14 is a schematic view of a method for manufacturing the device 200. Construction of the device 200 is made using a cooled elastomer method 600 which begins with providing 602 the requisite cap section 300, base section 400, and elastomeric plug 500. The cap section 300 and base section 400 may be formed by impact forming, machine forming, or simply cutting 604 a hex shaped rod or other appropriate tool shape. The gripping handle may be formed by simply bending 612 the hex shaped rod. Next, the process continues by cooling 606 the elastomeric plug 500 to increase its rigidity to allow for inserting 608 of the plug 500 into the apertures 322, 422 without significant deformation. The process continues by increasing 610 the plug 500 temperature to an operating temperature to return it to its elastic state.

Reference numerals used throughout the detailed description and the drawings correspond to the following elements:

a female aperture 100
an aperture shape 102
hexagon 104
aperture size 106
aperture depth 108
aperture side wall 110
first aperture wall 112
second aperture wall 114
third aperture wall 116
fourth aperture wall 118
fifth aperture wall 120
sixth aperture wall 122
A male tool device 200
a six sided hexagon 202
a cap section 300
a cap front face 302
an exposed surface 304
an exterior tool shape 306
first side 308
second side 310
third side 312
a cap rear face 314
a cap interior portion 316
a cap expansion profile 318
a cap length 320
a cap plug aperture 322
a cap aperture diameter 324
a cap aperture depth 326
a base section 400
a base front face 402
a base exposed surface 404
an exterior base shape 406
fourth side 408
fifth side 410
sixth side 412
a base cliff face 414
a base interior portion 416
a base expansion profile 418
a base interior length 420
a base plug aperture 422
a base aperture diameter 424
a base aperture depth 426
an elastomeric plug 500
a cylindrical body 502
a curved profile 504
a circular cross section 506
a plug diameter 508
a plug length 510
a distance 512
a handle 514
a bent extension 516
an L-shape 518
method 600
providing 602
cutting 604
cooling 606
inserting 608
increasing 610
bending 612

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A male tool apparatus adapted to fit within a female aperture having an aperture shape, the apparatus comprising:

a first section having an exposed surface defining a portion of an exterior tool shape and an interior portion defining a first expansion profile, the first section defining a first plug aperture;

a second section defining an additional portion of the exterior tool shape and an interior portion defining a second expansion profile, the first expansion profile and the second expansion profile adapted to relatively rotate to expand the exterior tool shape, the second section defining a second plug aperture; and an elastomeric connector attaching the first section to the second section, the elastomeric connector defining a plug inserted into the first and second plug apertures.

2. The apparatus of claim 1, the plug having a curved profile adapted to minimize shearing of the plug.

3. The apparatus of claim 1, The first section and the second section adapted to move a distance, the elastomeric connector having a cross section greater than the distance to allow movement without shearing.

4. The apparatus of claim 1, the exterior tool shape defining a six sided hexagon.

5. The apparatus of claim 4, the first section defining three sides of the hexagon; and the second section defining the remaining sides of the hexagon.

6. The apparatus of claim 1, further comprising a handle connected to at least one section.

7. The apparatus of claim 1, further comprising a bent extension connected to the first section.

8. The apparatus of claim 7, the bent extension forming an L-shape.

9. A hex key apparatus adapted to fit within a hex shaped aperture, the apparatus comprising:

a base defining a first side, a second side, a third side, and a first expansion profile with a first plug aperture;

a cap defining a four side, a fifth side, a sixth side, and a second expansion profile with a second plug aperture; and an elastomeric plug inserted into the first plug aperture and the second plug aperture.

10. The apparatus of claim 9, the plug having a diameter adapted to allow for repetitive use of the apparatus through nondestructive elastic deflection of the plug.

11. The apparatus of claim 9, the plug having a diameter adapted to frictionally retain the plug at least one of the plug apertures.

12. The apparatus of claim 9, further comprising a handle connected to the base.

13. The apparatus of claim 9, the base further comprising a bent extension.

14. The apparatus of claim 13, the bent extension forming an L-shape.

* * * * *